United States Patent [19]

Buluschek

[11] Patent Number: 4,570,875

[45] Date of Patent: Feb. 18, 1986

[54] AUTOMATIC TRAVERSING CONTROL

[75] Inventor: Bruno E. Buluschek, Ecublens, Switzerland

[73] Assignee: Maillefer S.A., Ecublens, Switzerland

[21] Appl. No.: 619,916

[22] Filed: Jun. 12, 1984

[30] Foreign Application Priority Data

Jun. 24, 1983 [CH] Switzerland ..... 3466/83

[51] Int. Cl.[4] ..... B65H 54/28

[52] U.S. Cl. ..... 242/158 R; 242/25 R

[58] Field of Search ..... 242/158 R, 158.2, 158.3, 242/158.4 R, 25 R

[56] References Cited

U.S. PATENT DOCUMENTS

| | | | |
|---|---|---|---|
| 3,948,462 | 4/1976 | Maillefer | 242/158 R |
| 3,951,355 | 4/1976 | Morioka et al. | 242/158 R |
| 4,150,801 | 4/1979 | Ikegami et al. | 242/158 R |
| 4,410,147 | 10/1983 | Seibert | 242/158 R |
| 4,456,199 | 6/1984 | Seibert | 242/158 R |

*Primary Examiner*—Stanley N. Gilreath

*Attorney, Agent, or Firm*—Parkhurst & Oliff

[57] ABSTRACT

A sliding base is guided for vertical movement on an upright of the traverse mechanism. It bears a camera having its lens directed along a horizontal axis toward a vertical bank of lights. A drum supported by uprights and driven rotatingly by a motor can move back and forth on rails, while the traversing carriage bearing vertical rolls guiding a cable can likewise move parallel to the axis of the drum in order to check and, if neccessary, modify the approach angle formed by the incoming cable about to be laid on the winding. The silhouette of the zone of the winding where the turns are laid down is formed on a receiving surface within the camera, this surface taking the form of a photodiode grid, the periodic scanning of which yields signals sensing the conditions under which the cable is being wound.

11 Claims, 7 Drawing Figures

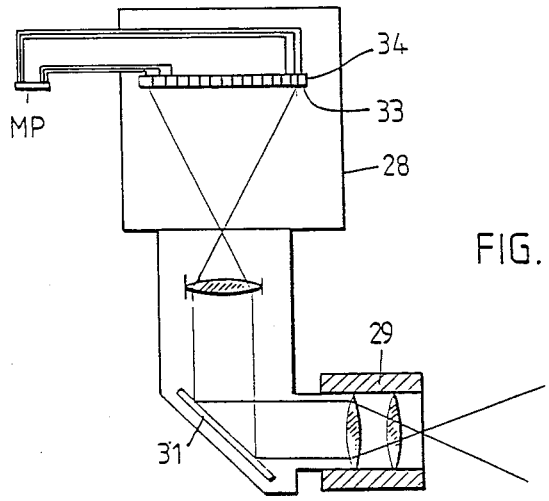
FIG. 4
FIG. 6
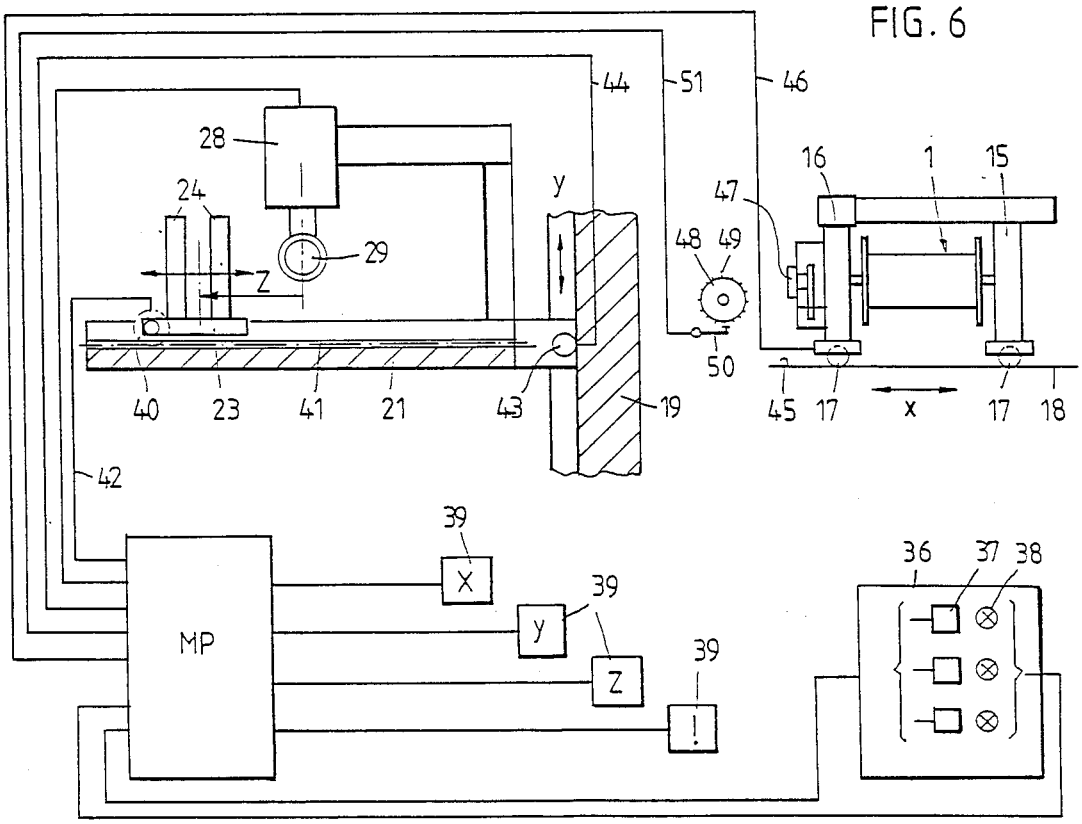

AUTOMATIC TRAVERSING CONTROL

BACKGROUND AND SUMMARY OF THE INVENTION

This invention relates to the winding of large-diameter cable on drums, and more particularly to apparatus for automatically controlling a traversing operation, of the type capable of controlling the formation, by cable coming from a production or treatment line, of a winding of successive turns and layers on the core of a drum to which the cable is attached, the drum being rotatingly driven about its axis on a support, and the cable passing through a cable-guide which is movable relative to the drum support in a direction parallel to the axis of the drum and guides the cable at a predetermined approach angle.

The term "large-diameter cable" is intended to mean insulated electric cable having an outside diameter of more than 10 mm. In general, however, the diameter of the cable does not exceed 60 mm. Normally, such cable is produced in the longest possible lengths and is wound on drums which are often as large as several meters in diameter. The winding machines holding these drums and rotating them are massive pieces of equipment which require large and powerful motors to drive them.

For example, the present assignee's U.S. Pat. No. 3,948,462 describes a winding machine of this kind in which the traversing carriage is supported by a rail parallel to the axis of the drum support, and the drum support itself comprises two mutually independent uprights capable of moving on rails which are likewise parallel to that axis. It is thus possible to carry out either traverse operations in which the traversing carriage and, consequently, the cable-guide move parallel to the axis of the drum along its entire length, or operations known as self-traversing, in which the traversing carriage remains stationary and it is the drum-support assembly which effects a translatory movement in front of the traversing carriage.

It has long been known how automatic traverse operations can be carried out on small winding machines intended to produce reels of telephone wire, for example, where the flanges of the reels are up to 40 cm. in diameter. In this case, the traversing carriage moves in front of the reel support, and its drive is connected to the reel drive, so that the traversing speed is proportional to the winding speed.

When it comes to winding large-size cable, however, it is not possible to control an automatic traverse operation simply by making the speed of the traversing carriage proportional to the speed of rotation of the drum; and until now it has been necessary for the traverse operation to be under the constant supervision of an operator.

To illustrate the mechanical conditions under which the successive turns of cable are laid on the drum core, we shall first consider FIG. 1 of the accompanying drawings, which shows schematically a drum 1 on which a cable 2 is being laid turn by turn. Drum 1 comprises a cylindrical core 3 and two disk-shaped end flanges 4 and 5. The leading end of a cable 2 is hooked into a hole 6 in drum core 3. Drum 1 is rotated in the direction indicated by arrow A so that a first turn touching flange 4 is laid down. At the end of this first turn, however, cable 2 must be deviated toward the left, as viewed in FIG. 1, so that the second turn will be positioned parallel to and touching the first turn. Thus, the winding of the cable on the drum core is not made up of successive, parallel helices but instead forms a series of irregular curves. In conventional winding machines where the operation is constantly monitored by an operator, the incoming portion of cable, designated as 7, is kept at a suitable angle called the approach angle, designated as r in FIG. 1. It will be obvious that when a full layer of turns has been laid down, the angle of portion 7 relative to a plane perpendicular to the axis of the drum has to be changed, and when the last turn of a layer is being laid down, that angle must be reduced to zero. Then, when the first turn of the following layer has been formed, portion 7 of the cable must be guided in such a way that the approach angle is reversed, for while a layer is being formed from left to right, that angle must be inverted as compared with its value during the formation of a layer from right to left.

It is an object of this invention to provide improved apparatus for the automatic control of a traverse operation, suitable for equipping large winding machines which are able to support and rotate drums intended to receive considerable lengths of cable having a diameter of more than 10 mm.

To this end, in the control apparatus according to the present invention, of the type initially mentioned, the improvement comprises projection means for forming on a receiving surface an image of the silhouette of a predetermined zone of the winding, sensing means sensitive to the image and capable of generating an electrical signal representing the silhouette, means for analyzing and processing the signal and supplying control signals, and drive means responsive to the control signals for causing relative movements between the cable-guide and the drum support as a function of the result of the analysis.

BRIEF DESCRIPTION OF THE DRAWINGS

A preferred embodiment of the invention will now be described in detail with reference to the accompanying drawings, in which:

FIG. 4 is a diagrammatic view of the optical system forming part of the control apparatus, FIG. 6 is a circuit diagram of the essential elements of the control apparatus.

DETAILED DESCRIPTION OF THE PREFERRED EMBODIMENT

Figure 2:
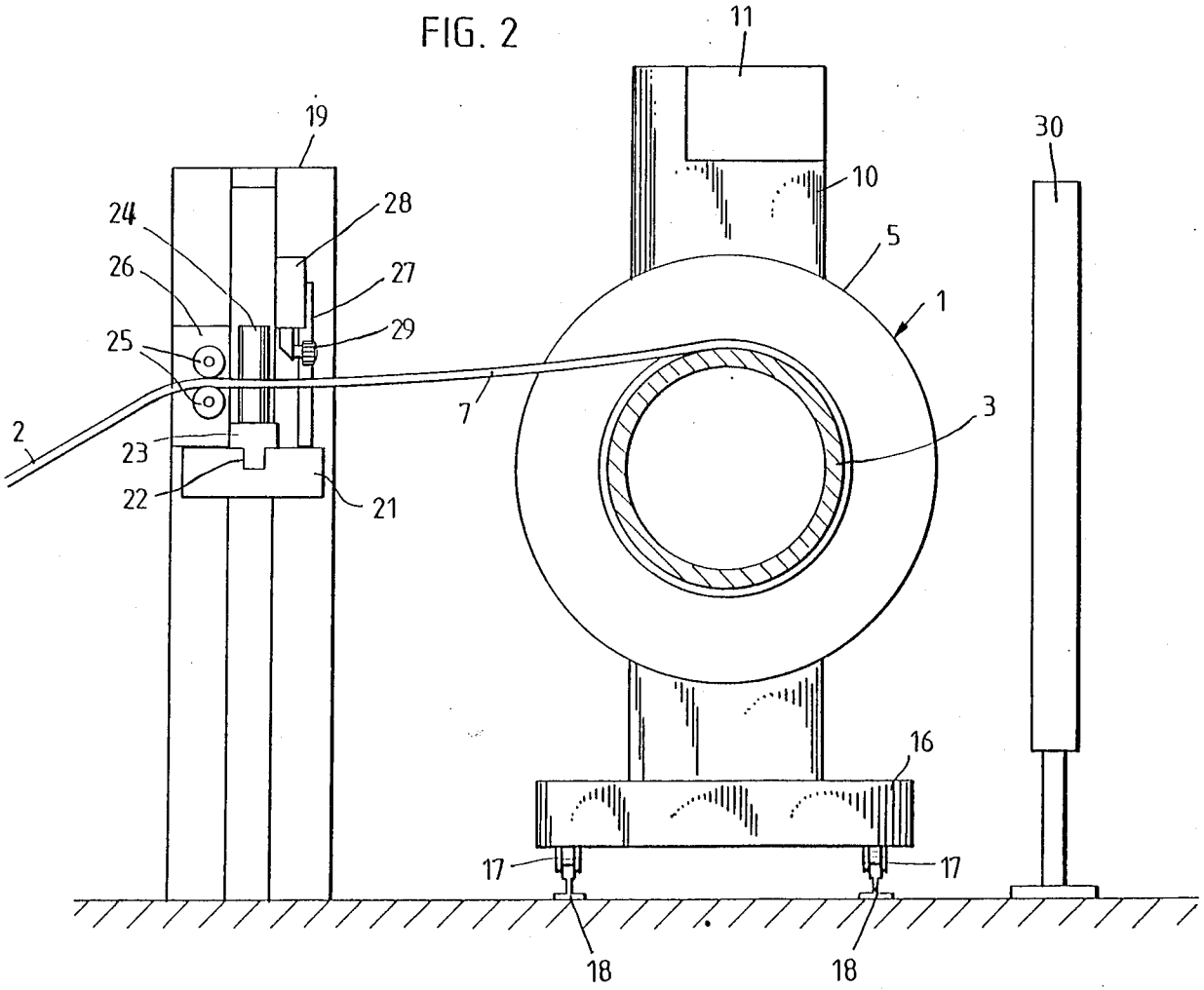
FIG. 2 is a section taken on a plane perpendicular to the axis of the drum in a winding machine equipped with the preferred embodiment of the control apparatus.
Figure 1:
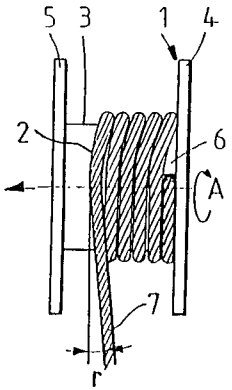
FIG. 1, already described above, is a diagrammatic view of a drum being wound.
Figure 3:
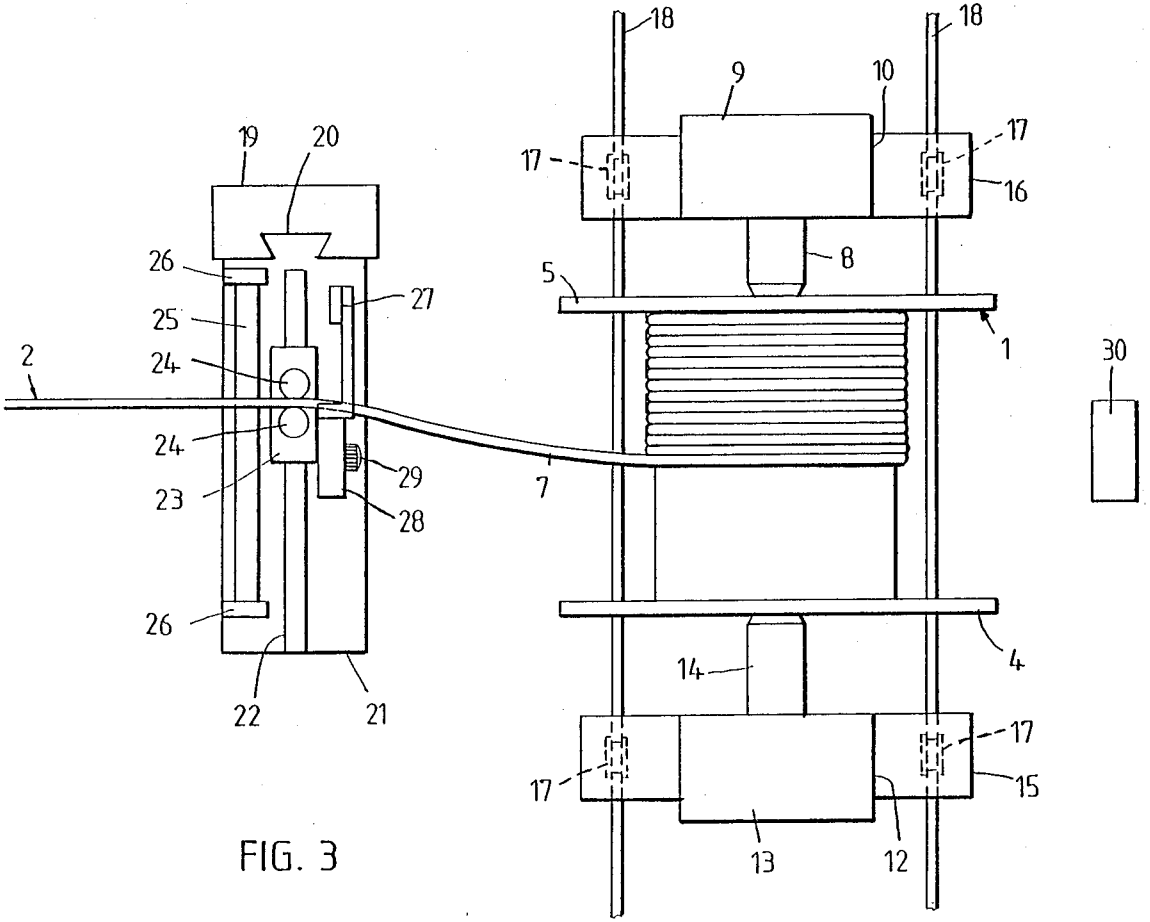
FIG. 3 is a top plan view of the winding machine shown in FIG. 2.

The winding installation shown in FIGS. 2 and 3 will first be described briefly, the parts mentioned above in connection with FIG. 1 being designated here by the same reference numerals. In FIG. 2, core 3 and left-hand flange 5 of drum 1 are shown in section taken on a plane perpendicular to the axis of rotation of drum 1. Flange 5 is supported by a trunnion 8 (FIG. 3), borne in turn by a bearing 9 integral with the left-hand upright 10 of the winding machine. An upper crosspiece 11 of the winding machine (FIG. 2) extends parallel to the axis of drum 1 and guides the top of an upright 12 comprising a bearing 13 which in turn guides a trunnion 14 supporting the right-hand flange 4 of drum 1. Uprights 10 and 12 rest upon pedestals 15 and 16 provided with rollers 17 which run on two parallel rails 18. Rollers 17 are connected to drive means by means of which the winding machine as whole can be moved back and forth on rails 18, while means (not shown) for driving drum 1 cause the rotation of one of the trunnions 8 or 14 provided with elements coupling them to the associated flange of the drum. The drum-driving means are capable of rotating the drum about its axis at a constant or variable speed as a function of conditions which may be predetermined. Thus, for example, the drum may be driven at a constant resistance torque.

Placed in front of the winding machine proper is a traversing support comprising a rigid upright 19 provided with guide means represented in the drawing by a dovetail groove 20 running vertically and guiding a horizontal arm 21 which can thus be moved up and down along upright 19. In the top of support arm 21 there is also a guide groove 22 in which a traversing carriage 23 slides. Carriage 23 bears two parallel, vertical-axis cylindrical rolls 24 spaced from one another in such a way that incoming portion 7 of cable 2 is closely guided between rolls 24. Carriage 23 can be moved reciprocatingly by drive means (not shown) parallel to the axis of drum 1 in front of the latter, portion 7 of cable 2 being further guided above and below between two horizontal rolls 25 likewise spaced from one another to match the diameter of cable 2. Rolls 25 are supported at their ends by uprights 26 which rest on the base formed by support arm 21. By means of another support arm 27 integral with horizontal base 21, a camera 28 can be secured above that base. The principle of the optical system of camera 28 is depicted schematically in FIG. 4. It has a lens 29, the axis of the optical system of which is oriented horizontally and perpendicular to the axis of drum 1. As arm 27 is supported by base 21 which is displaceable vertically, the level of the axis of lens 29 may be selected at will; and as will be seen below, it is so controlled that this axis is tangent to the last complete layer of the winding built up on drum 1. It will be understood that depending on the circumstances, a different direction from what has just been described may be chosen for the axis of lens 29, particularly a slightly inclined direction, although the rule of tangency to the last complete layer of the winding is a general rule.

Finally, the illustrated winding installation comprises a bank of lights 30 disposed vertically facing camera 28 but on the other side of the drum. It will be understood that the effect of lights 30 is to project in a direction perpendicular to the axis of drum 1 the image of the silhouette of the winding, i.e., the image which would be obtained by cutting the winding being formed along a vertical plane passing through the axis of drum 1.

Figure 5:
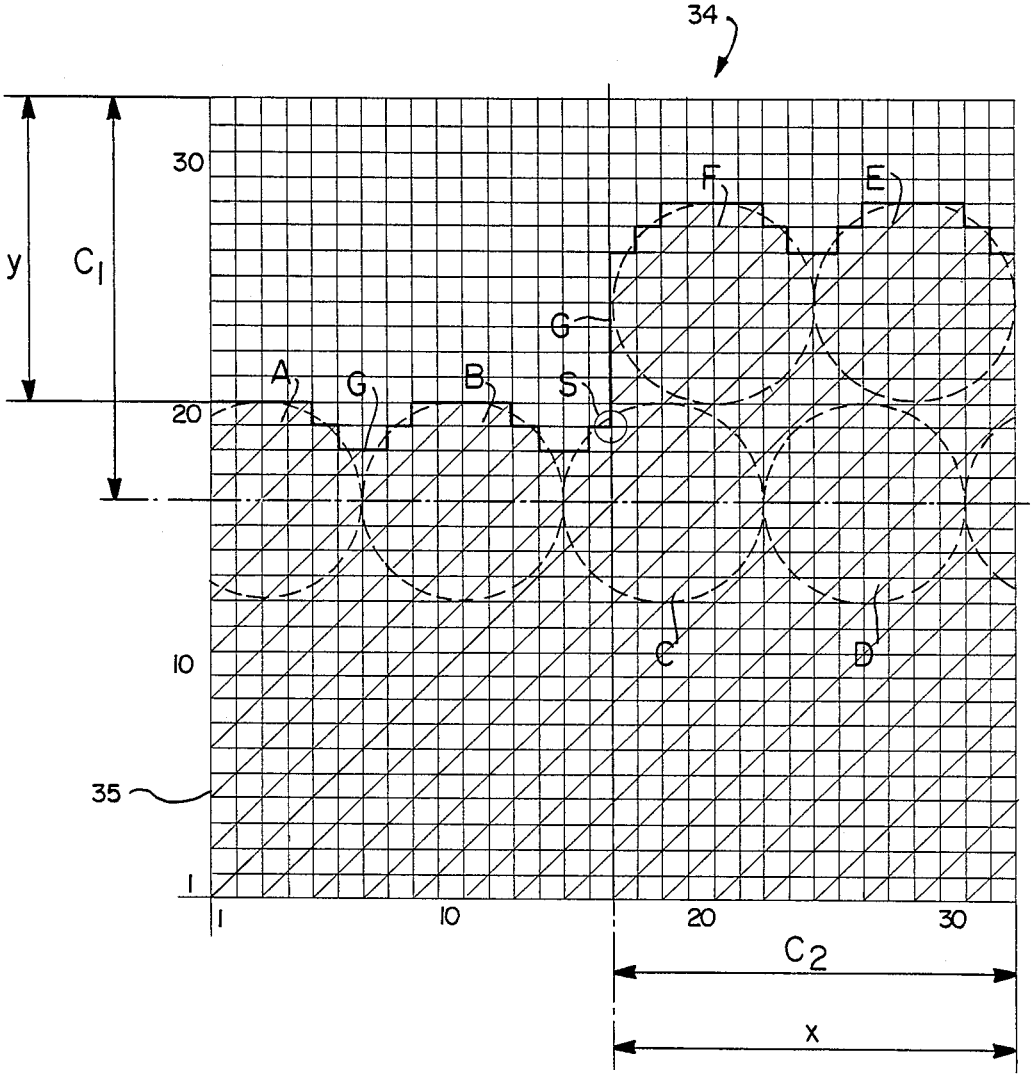
FIG. 5 is a diagrammatic view on a larger scale, showing a grid of photoelectric elements used in the control apparatus to be described.

The principle of camera 28 will now be described. It is an optical apparatus of a type known per se, particularly a camera sold under the trademark RETICON by Reticon Corporation, Sunnydale, Calif., a subsidiary of EG&G, Inc., Wellesley, Mass. This instrument, called an "image sensing camera," includes a zoom lens by means of which the focal length and magnification of the camera can be varied. The image formed by the lens is reflected by a 45° mirror 31 and projected as a real image on a receiving surface 33 in the form of a grid 34 which, in the embodiment being described, is square and composed of an array of photosensor cells. These cells, e.g., photodiodes, are connected in a circuit taking the form of a microprocessor MP, e.g., an Intel SBC 80. In the present embodiment, it has been found that a grid 34 formed of 1,024 cells distributed over a square of thirty-two cells per side yields sufficiently fine sensing to meet the operating conditions. The bank of lights 30 projects onto lens 29 the shadow of the silhouette of the winding. Lens 29 itself makes it possible to select the size of the zone of the winding which will be projected onto grid 34, and it has been found in particular that magnification such that the zone of the winding which is projected onto grid 34 appears as shown in FIG. 5 is a suitable magnification. In FIG. 5, we see on grid 34, formed of 1,024 photosensor cells, the image of the silhouette of part of the winding comprising four turns of cable designated A, B, C, and D, forming part of the last full layer laid on the drum, and the image of the last two turns E and F of the layer being formed, turn F being a partial turn, and the geometric arrangement being such that the part of the silhouette designated F represents the location where portion 7 of cable 2 has just been laid on the winding. It will be seen that the cells are so adjusted that their condition (conductive or non-conductive) changes according to whether they are exposed to the illumination of lights 30 or whether lights 30 are hidden for them by the winding. The 1,024 cells are preferably distributed in series, with each series corresponding to a row, so that by suitable switching of the electronic circuit MP, a scanning operation can be carried out at any moment, during which all the sensor elements of grid 34 will be examined successively, e.g., by successive rows. This examination will give rise to an electrical signal composed of a train of binary-coded pulses indicating for each element of grid 34 its illuminated or shaded condition. The photodiodes of grid 34 will preferably be examined by successive series, each series being composed of the elements of the same row.

FIG. 5 gives the result of such an examination by way of example. In this drawing figure, the 1,024 photosensing elements of grid 34 are represented in the form of a square matrix numbered by line and by row. The elements themselves are designated by reference numeral 35. The image of the silhouette of a predetermined zone of the winding, as it appears on grid 34, is clearly shown in FIG. 5. The silhouette of two turns A and B of the last full layer laid on the winding is plainly visible in the left-hand part of the image, together with part of the silhouette of a turn C belonging to the same layer. A fourth turn D of the last full layer is completely buried in the portion of the image where the elements are hidden from the light. Above this full layer, two turns E and F of the layer being formed are seen to appear. As it is shown in the drawing, this layer being formed is made up of successive turns going from right to left, although in reality this may correspond to a layer being formed from left to right, owing to the reversal of the image.

The winding being formed hides the cells 35 situated to the right of and below a boundary line G in FIG. 5, this line enclosing the profiles of turns A, B, C, F, and E. Through analysis of the condition of the cells adjacent to line G, a program step introduced into microprocessor MP can determine at any given moment the position on grid 34 of a point S on line G, corresponding to the apex of the re-entrant right angle defined by the profiles of turns B, C, and F. The essential characteristics of the sensed image are thus represented by the co-ordinates Y and X of point S on grid 34.

The center point of grid 34 being determined by reference co-ordinates C1 and C2; the ordinate designates the level along the y-axis at which the upper line of the layer formed by turns A, B, C, and D is situated, whereas the abscissa designates the position along the x-axis of the free flank of the image of turn F. After a comparison of the result of a scan of grid 34 with the predetermined reference values C1 and C2, the electronic circuit can transmit control signals which will act upon the various drive means included in the apparatus in order to correct the position of point S determined by coordinates X and Y and make it coincide with the center of the image, i.e., with co-ordinates C1 and C2.

FIG. 6 gives a more precise operating diagram of the control apparatus described above, and it shall now be explained how the result of the analysis of the image formed on grid 34 with each scan of photodiodes 35 is processed to act upon the drive means. FIG. 6 shows microprocessor MP which receives data from the various sensor means and supplies commands to the drive means. A control panel 36 comprises a number of control buttons 37 associated with indicator lamps 38 by means of which the apparatus can be put in the necessary condition so that the different control programs can run. The various drive means are represented by blocks 39 marked x, y, z, and !, respectively. The box marked ! is an alarm signal for attracting the attention of the supervisory personnel when a situation not foreseen by any of the programs presents itself. The drive means marked z is a motor which acts upon traversing carriage 23, already described above in connection with FIG. 2. This motor may, for instance, drive a pinion 40 engaging a rack 41 borne by base 21. The latter moves vertically on upright 19 of the traverse mechanism. FIG. 6 shows camera 28, which is supported in a fixed position horizontally but is movable vertically by base 21. By means of control motor z, the two guide rolls 24 can be moved horizontally relative to camera 28. Rack-and-pinion gear 40, 41 is likewise equipped with a position sensor which, over a line 42, supplies circuit MP with data on the instantaneous position of rolls 24, between which the cable passes, relative to base 21 and, consequently to camera 28.

Drive motor y acts upon base 21, in a manner not shown in detail in FIG. 6, to move it along upright 19. A sensor 43 is likewise associated with base 21 so that, over a line 44, data on the level of base 21 and, consequently, of camera 28, can be transmitted to circuit MP.

Finally, motor x acts upon pedestals 15 and 16 of the gantry-type winding machine and controls rollers 17, thus causing the whole winding machine to move along rails 18. A position marker 45 and a sensor incorporated in the control of rollers 17 make it possible to transmit to circuit MP, over a line 46, data on the instantaneous position of the winding machine along rails 18.

The motor which rotates drum 1 is shown diagrammatically in FIG. 6 and designated by reference numeral 47. Normally, motor 47 is not controlled directly as a function of the result of the analysis of the image appearing on grid 34, for it must answer other requirements. Its speed, for example, will be regulated as a function of the resistance encountered by the cable in the line from which it emanates, and motor 47 will rotate the drum with a constant resistance torque, for instance. It can also operate at a constant speed of rotation. Nevertheless, an orientation sensor, shown schematically in FIG. 6, is associated with motor 47. A wheel 48 rotating at the same speed as drum 1 may be provided with regularly spaced stops 49 so as to supply signals when passing close to a position sensor 50, these signals being transmitted over a line 51 to circuit MP, in which they reach a counter which thus stores the orientation of the drum at each moment.

It remains to be explained how the apparatus described above can be programmed to control the uniform winding, turn by turn and layer by layer, of cable 2 on drum 1 when the image projected on grid 34 represents only a small-sized zone of the profile of the winding.

Before starting the control apparatus, the winding operation must be prepared for by first hooking the end of the cable in hole 6 (FIG. 1), which is situated at one end of drum core 3, either at the right or at the left, the drum being placed so that hole 6 is on the upper horizontal generatrix of the core. The traverse mechanism, i.e., to be exact, base 21, will be placed so that camera 28, the axis of lens 29 of which is fixed, is situated well above core 3 of drum 1. As shown in the drawing, this axis is oriented horizontally and perpendicular to the axis of the drum, although different axes may be chosen. However, any movement of the winding machine or of base 21 bearing camera 28 should keep this axis parallel to itself. Another essential adjustment to be made before starting up the apparatus consists in setting the magnification of the optical system 29 of camera 28 as a function of the diameter of the cable. It is for this purpose that camera 28 is equipped with a zoom lens 29. The magnification will therefore be adjusted so that the image projected on grid 34 corresponds in length to about four turns. The conditions illustrated in FIG. 5 correspond approximately to actual conditions, and it will be seen that line G, formed of right-angle segments of straight lines bounding the excited photodiodes as compared with those which are not, gives an analog image of the real silhouette of the profile of the winding.

In order that the automatic control apparatus may be started up, camera 28 should first be lowered, and a program should be initiated which brings the upper generatrix of the drum core into the center of the image, i.e., the ordinate Y is made equal to the value of the reference C1. This result is obtained by acting upon motor y which moves base 21. The winding machine is then moved by acting upon motor x so that the image of the flange next to which the cable is hooked appears in the center of the grid, i.e., so that the abscissa X is equal to C2.

The program of preparation for the operation of the automatic control apparatus includes adjustment of the starting position of carriage 23. This carriage must be moved on base 21 through control of motor z in such a way that the abscissa Z equals zero, or in other words, so that the center of the distance between the two rolls 24 coincides with a vertical reference plane which marks the axis of the lens of camera 28. Under these conditions, motor 47 driving drum 1 can be started. The first turn is laid down on the core of the drum along the flange; and after about three-quarters of a revolution, which is sensed by sensor 48,49,50, a movement of traversing carriage 23 over a distance $z=D/2$ (D being equal to the diameter of the cable) is effected in order to go on to the formation of the second turn of the winding. The beginning of this second turn is immediately sensed on grid 34 by the fact that the abscissa X, which marks the free flank of the last turn of the winding (turn F) differs from the value C2. As grid 34 undergoes a scanning operation at repeated intervals, e.g., every 20 ms, this sensing takes place immediately; and according to the results of the analysis, control signals are sent to one or the other of the motors x or z, or possibly to both motors at once. Moreover, signals may also be sent to motor y together with or separate from the signals sent to motors x and z.

In fact, one of the important particularities of the apparatus being described is that, depending upon the extent or the rapidity of the image variation sensed in comparison with the reference image corresponding to the desired conditions, differentiated control signals acting either on motor x or motor z will be transmitted by circuit MP. Normally, the position of traversing carriage 23 relative to the axis of lens 29, i.e., co-ordinate Z, will be adjusted to correspond to a reference value giving the desired angle r. When the first turn is laid down, this angle is adjusted to be zero, then it takes the value of an approach angle determined in conformity with the winding conditions to ensure the uniform deposit of the following turns, one against the other. However, when abnormal conditions are sensed, this angle may be temporarily modified. For that purpose, it suffices to program the analysis of the signals representing the image projected onto grid 34 in order that the control signals emitted will act upon motor z. Because the movable unit 23, 24 has much lower inertia than the drum and its support, corrections of angle r can be quickly made by means of motor z. However, after any abnormal deviation, the program incorporated in circuit MP will tend to re-establish the optimum angle r by acting on motor z and at the same time on motor x so that the whole of the drum gradually passes in front of lens 29 of camera 28.

A reversal control program is automatically initiated whenever a layer formed of turns A, B, C, and D is almost complete. The ending of a layer of turns is sensed in that the flange opposite the starting flange, or to be exact, the inner face of that flange, appears in the image projected on grid 34. It will be readily understood that this can be sensed by the fact that all the photodiodes of one or more of the end rows of the grid are hidden as soon as this flange appears in the image. This situation triggers the start of the reversal program, comprising the following operations:

shifting the traversing carriage in order to return angle r to zero (reset), sensing the appearance of the first turn of a new layer next to the flange and controlling motor y in order to raise base 21 and thus return ordinate Y to value C1, sensing a rotation of about three-quarters of a revolution of drum 1, controlling traversing carriage 23 in order to move the cable laterally by the distance $z=D/2$, controlling motors z and/or x in order to bring the free flank of the turn being laid to abscissa C2, re-establishing approach angle r, but with its orientation the reverse of what it was for the preceding layer.

When the reversal program has been carried out and checked, the control apparatus automatically restarts the winding control program, which runs until the new layer is almost complete and the inside surface of the opposite flange once more appears in the image.

The laying of successive turns of cable on the core of a drum or on layers of a winding already formed may present numerous irregularities, so that the sensing of the actual situation and differentiating between a normal situation and an abnormal situation which requires correction demand high precision in the analysis of the image of the silhouette of the winding. It has been found, however, that thanks to the use of a camera which forms the image of this silhouette on a grid of photosensing elements, such as photodiodes, known devices can provide a reliable solution to the problem posed. By limiting the image of the silhouette to a zone of the winding of predetermined size, and by selecting a camera having relatively low resolution, it has been possible to provide a grid having a number of photosensing elements which is not excessive and to observe the image of the profile of the turns with adequate precision. Thus, the apparatus described makes it possible to act immediately and to correct abnormal deviations without the number of connections to be established and the complexity of the scanning circuits reaching unverifiable values, for example. It has thus turned out that a grid thirty-two elements long and thirty-two elements wide, hence of 1,024 elements in all, is fine enough to be able to guide and control under satisfactory conditions the variable parameters which are to be governed.

Another important element of the apparatus described is that owing to the use of a zoom lens, the field of the image transferred to the grid can be adjusted at will as a function of the diameter of the cable. In other words, whatever the cable diameter, a line G surrounding a constant number of turns formed or being formed can be obtained on grid 34. The same control apparatus can thus be utilized for winding cable of different diameters, representing a considerable advantage during use of the apparatus in practice.

Figure 7:
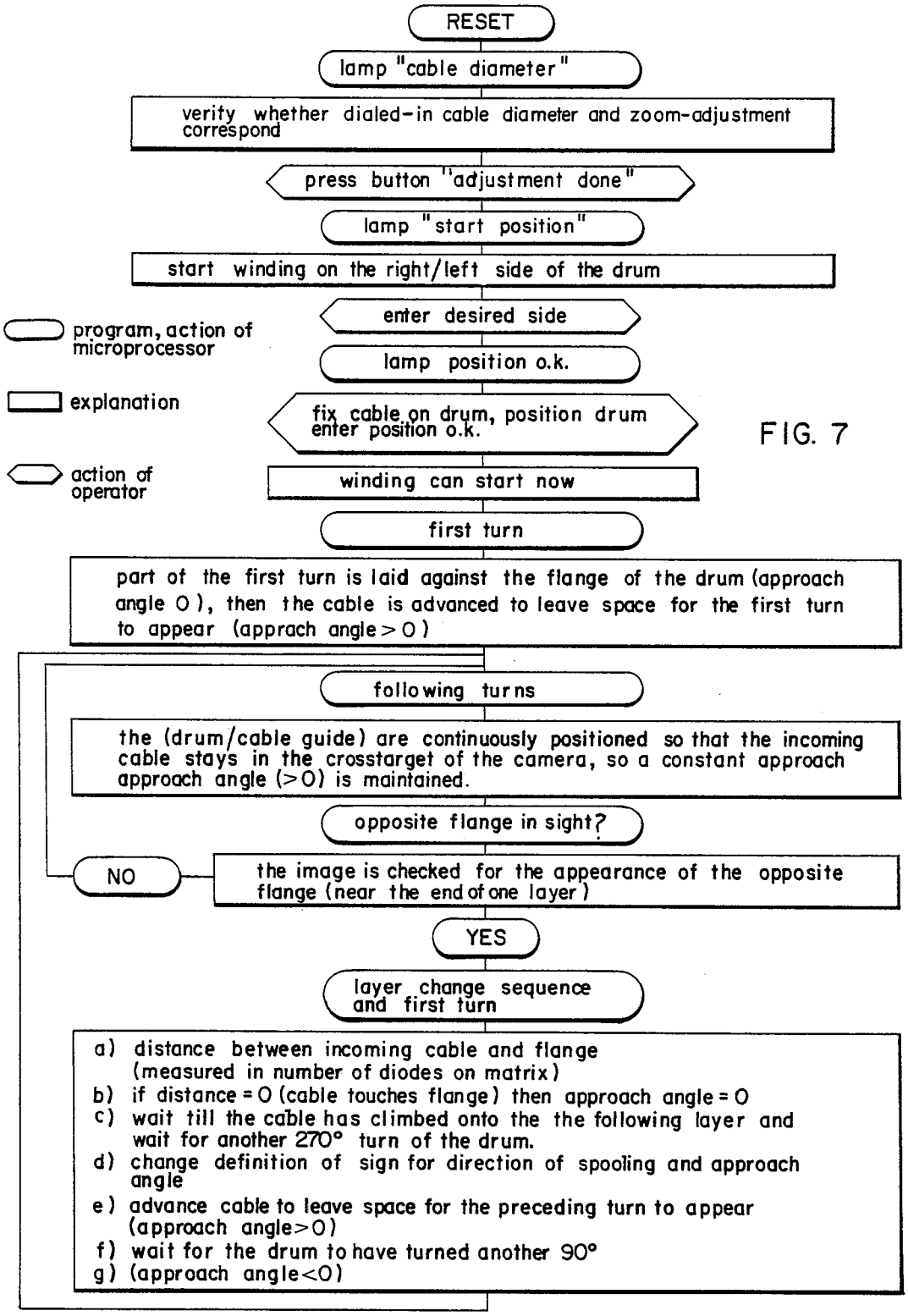
FIG. 7 is a flowchart explaining the program.

Tests have shown that by running the repetitive program summarized in the flowchart of FIG. 7, it is possible to monitor and automatically control the winding of cable on drums several meters in diameter and weighing several tons, which considerably simplifies carrying out these operations.

The basic element of the program is that at the moment when a new turn is formed, point S moves relative to the point of intersection of co-ordinates C1, C2. This adjustment deviation expressed by a number of obscured cells 35 is sensed by the microprocessor, and a signal is transmitted to one of the adjusting motors in order to make up the sensed deviation.

Special algorithms automatically control the three essential operations to be carried out during winding of the cable:

1. Place point S at the point of intersection of co-ordinates C1, C2.

2. Raise base 21, reverse the traversing direction, and change angle r at the moment when the layers change.

3. Sense that the turns of the last layer are situated at the peripheries of the flanks of the drum, and stop the winding at the end of that layer.

It will be noted that all the normal operations described above can be performed almost solely on the basis of the data sensed when line G is analyzed. The only outside item of information entering into these operations is the measurement of a rotation of three-quarters of a revolution from the beginning of each turn, for preparing the turn shift. The limit sensors described above function as safety elements.

Although the foregoing description pertains to a camera having an optical system which may comprise $3\times3$ mm. grid 34, it will be obvious that the projection means suitable for forming the image of a predetermined zone of the winding on the receiving surface might be some other type of means, using radiation other than visible light rays, e.g., infrared radiation, or if need be, supersonic beams.

Generally speaking, "projection means" is understood to mean any arrangement, the effect of which is that a radiation undergoes a partial occultation by the profile or outline of the winding in the vicinity of the winding point, and using this occultation for delimiting two zones on the receiving surface, one presenting the profile of the winding and the other the environment outside that profile.

It has been found that a particularly advantageous projection means is a lamp fixed immediately beneath the camera lens, directing a beam of light along an axis parallel to that of the lens, and a flat panel which has properties tending to reflect the light from the lamp and is disposed vertically and parallel to the axis of the drum at the location of lights 30, in place of the latter. As a reflective panel, it is possible to use any plane surface covered with a sheet of material having catadioptic properties, such as the sheeting sold by the 3M Company under the registered trademark "Scotchlite". In certain cases, e.g., if the drum is situated in front of alight-colored wall or a glazed bay, the lamp and reflecting panel may even be dispensed with, the "projection means" then consisting of the wall or the bay and the ambient light. In other cases, e.g., if the environment of the drum is dark, the lamp placed under the camera lens may provide sufficient contrast in lighting up the drum so that the outline of the drum appears light-colored as compared with the dark surroundings on the receiving surface covered by the photosensor grid.

What is claimed is:

1. An apparatus for automatically controlling a traversing operation which controls the formation of a winding of successive turns and layers on the core of a drum, said turns and layers being formed by a cable coming from a production or treatment line, the eable being attached to the drum, the drum being rotatably driven about its axis on a support, and the cable passing through a cable-guide which is movable relative to the drum support in a direction parallel to the axis of rotation of the drum for guiding the cable at an approach angle, said apparatus comprising:

projection means for forming an image of the silhouette of a predetermined zone of said winding;

a receiving surface for receiving the projection of said silhouette;

sensing means sensitive to said image for generating electrical pulses representing said silhouette;

means for analyzing and processing said pulses and supplying control signals; and drive means responsive to said control signals for causing relative movement between said cable-guide and said drum support, said relative movement being automatically controlled according to a predetermined function of the results of the analysis so that the approach angle is held at a constant value upon sensing of a normal image by said sensing means but undergoes a transient variation upon sensing of an abnormal image by said sensing means.

2. An apparatus for automatically controlling a traversing operation which controls the formation of a winding of successive turns and layers on the core of a drum, said turns and layers being formed by a cable coming from a production or treatment line, the cable being attached to the drum, the drum being rotatingly driven about its axis on a support, and the cable passing through a cable-guide which is movable relative to the drum support in a direction parallel to the axis of rotation of the drum for guiding the cable at an approach angle, said apparatus comprising:

projection mean for forming an image of the silhouette of a predetermined zone of said winding;

a receiving surface for receiving the projection of said silhouette;

sensing means sensitive to said image for generating electrical pulses representing said silhouette;

means for analyzing and processing said pulses and supplying control signals; and drive means responsive to said control signals for causing relative movement between said cable-guide and said drum support as a function of the results of the analysis, said drive means comprising first drive means for causing relative movement parallel to sai axis between said cable-guide and said projection means and second drive for causing relative movement parallel to said axis between said drum support and said projection means, both said first and second drive means being responsive to said control signals, and said means for analyzing and processing said pulses determing said relative movement such that said approach angle is held normally at a constant and predetermined value while undergoing transient modification depending on said function.

3. The apparatus according to claim 2, wherein said second drive means are responsive to said control signals to maintain said approach angle at said constant value, and said first drive means are responsive to said control signals to transiently modify said approach angle according to said function.

4. The apparatus of claim 2, further comprising means for sensing the relative positions of said cable-guide and said drum support relative to said projection means, said means for analyzing being so designed that the processing of said control signals utilizes sensing signals indicating said relative positions.

5. The apparatus of claim 2, wherein said projection means comprise an optical system and said means for sensing comprise a grid of photosensing elements placed on said receiving surface, said optical system being so designed that said predetermined zone of which said image is formed on said grid comprises the silhouette of a predetermined number of said turns and of a predetermined number of said layers, said number being independent of the diameter of said cable.

6. The apparatus of claim 5, wherein said image is rectangular and comprises the silhouette of a zone of said winding about four said turns in length and about two said layers in height.

7. The apparatus of claim 5, wherein said sensing means comprise scanning means actuated periodically and forming upon each actuation a binary-coded pulse train representing the condition of said photosensing elements.

8. The apparatus of claim 5, wherein said drive means further include third drive means for moving said optical system and said grid of photosensing elements jointly at right angles to said axis of rotation of said drum, said means for analyzing being adapted to produce control signals capable of acting upon said third drive means, whereby a line formed in said image by the upper edge of the last complete said layer of said winding is kept situated halfway up said grid.

9. The apparatus of claim 8, wherein said means for analyzing are so designed that said control signals act upon said first and second drive means to keep in the center of said grid a point of said image of the silhouette of said winding corresponding to the apex of a reentrant angle formed between the free edge of the last said turn of the upper said layer being formed and the upper edge of the last complete said layer of said winding.

10. The apparatus of claim 9, wherein said means for analyzing are designed to produce signals for controlling a reversal of traversing when said image of the silhouette of said predetermined zone of said winding includes an end of said core of said drum.

11. The apparatus of claim 10, further comprising a sensor of the orientation of said drum relative to a reference plane containing said axis of rotation of said drum, said sensor transmitting orientation signals, and said orientation signals being used in controlling said reversal of traversing.

* * * * *